US012728953B2

(12) United States Patent
Caponnetto et al.

(10) Patent No.: US 12,728,953 B2
(45) Date of Patent: Sep. 8, 2026

(54) FOLDABLE HYDROFOIL FOR BOATS

(71) Applicant: CAPONNETTO HUEBER S.L., Valencia (ES)

(72) Inventors: Mario Caponnetto, Valencia (ES); Francis Hueber, Valencia (ES)

(73) Assignee: CAPONNETTO HUEBER S.L., Valencia (ES)

( * ) Notice: Subject to any disclaimer, the term of this patent is extended or adjusted under 35 U.S.C. 154(b) by 298 days.

(21) Appl. No.: 18/648,294

(22) Filed: Apr. 26, 2024

(65) Prior Publication Data

US 2024/0278874 A1 Aug. 22, 2024

Related U.S. Application Data

(63) Continuation-in-part of application No. PCT/EP2022/080641, filed on Nov. 3, 2022.

(60) Provisional application No. 63/462,159, filed on Apr. 26, 2023.

(30) Foreign Application Priority Data

Nov. 3, 2021 (EP) ..... 20213829
May 10, 2023 (WO) ..... PCT/EP2023/062525

(51) Int. Cl.

| | |
|---|---|
| ***B63B 1/24*** | (2020.01) |
| ***B63B 1/26*** | (2006.01) |
| ***B63B 1/30*** | (2006.01) |
| ***B63B 79/40*** | (2020.01) |
| ***B63H 21/17*** | (2006.01) |

(52) U.S. Cl.
CPC ..... *B63B 1/30* (2013.01); *B63B 1/246* (2013.01); *B63B 1/26* (2013.01); *B63B 79/40* (2020.01); *B63H 21/17* (2013.01)

(58) Field of Classification Search
CPC ..... B63B 1/30; B63B 79/40; B63B 1/246; B63B 1/26; B63H 21/17
See application file for complete search history.

(56) References Cited

U.S. PATENT DOCUMENTS 3,343,513 A * 9/1967 Bader ..... B63B 1/246 114/282
3,613,622 A * 10/1971 Bueller ..... B63B 1/30 114/282
4,056,074 A * 11/1977 Sachs ..... B63H 20/106 114/280
5,448,963 A * 9/1995 Gallington ..... B63B 1/283 114/274

(Continued)

FOREIGN PATENT DOCUMENTS

FR 2379425 A1 9/1978
GB 1179881 A 2/1970

(Continued)

*Primary Examiner* — Benjamin F Fiorello

(57) ABSTRACT

The invention is directed to a watercraft comprising multiple set of foils, that may be used to convey passengers and goods on regular transport services provided on rivers, lakes or between islands, with low GHG emissions, notably but not exclusively using electrically powered propelling systems supplied by a battery or a fuel cell. The combination of the foil sets in a distributed wingspan allows to reduce the induced drag of the boat while retracting mechanisms allows to reduce the overall width of the boat for docking.

26 Claims, 8 Drawing Sheets

(56) References Cited

U.S. PATENT DOCUMENTS

| | | | | |
|---|---|---|---|---|
| 6,499,419 | B1 | 12/2002 | Bussard | |
| 10,363,993 | B2 | 7/2019 | Dalrymple Smith | |
| 2023/0257073 | A1* | 8/2023 | Van Hardenbroek Van Ammerstol | B63B 1/244 114/279 |
| 2024/0166304 | A1* | 5/2024 | Bieker | B63B 1/242 |

FOREIGN PATENT DOCUMENTS

| | | | |
|---|---|---|---|
| JP | S4216496 | Y1 | 9/1967 |
| WO | 2016034814 | A1 | 3/2016 |
| WO | 2022019764 | A2 | 1/2022 |

* cited by examiner

FOLDABLE HYDROFOIL FOR BOATS

CROSS REFERENCE TO RELATED APPLICATIONS

This application is a Continuation in Part of PCT/EP2022/08641 filed on Nov. 3, 2022 which claims priority of EP202138291 filed on Nov. 3, 2021 and further claims priority of PCT/EP2023/062525 filed on May 10, 2023 and US provisional application U.S. 63/462,169 filed on Apr. 26, 2023. The content of all of these applications is hereby introduced by reference.

TECHNICAL FIELD

The invention belongs to the field of watercrafts, more specifically to boats comprising foils.

More specifically it is directed to a watercraft that may be used to carry passengers or goods on rivers, lakes, sea or between islands, with low GHG emissions, notably using electrically powered propelling systems supplied by a battery or a fuel cell, sails or combination thereof.

Such a watercraft has reduced energy consumption while being capable of a high commuting speed.

BACKGROUND OF THE INVENTION

Foils are hydrodynamic devices attached to a displacement hull of a boat that allow the displacement hull to lift-up and to hover over the water surface once a takeoff speed is reached, thus dramatically reducing the drag of the boat.

For the foil to be effective it shall comprise a foil surface having a wing profile that is at least partially immersed.

For a given foil with a given fixed wing profile, the lifting force depends on the square of the speed of the boat, the higher the speed the higher the lift force.

The lifting force also depends on the wing surface area, the larger the surface area the higher the lifting force for a given speed.

However, the larger the wing surface area the higher the viscous drag, more specifically before reaching the critical takeoff speed which in turn requires more energy to be reached.

It is therefore a compromise to be found between the beneficial effects of the foils at high speeds and their drawbacks at low speed.

Also, the drag decreasing once the boat takes off, riding speed increases which increases the lifting force to the point where the wing of the foil may become too close to water surface to a point where the lift is lost, thus resulting in an uncomfortable ride.

To avoid this phenomenon, over the takeoff speed, the lifting force shall be kept constant so as to simply balance the weight of the boat.

It is known in the art to use so-called surface piercing foils. In such a configuration the foils are slantly attached to the hull, forming a V shape. As the boat accelerates, the foils generate more lift, raising the boat, which in turn reduces the amount of foil in the water until equilibrium is achieved. The boat finds its own ride height automatically, with no moving parts required.

Surface piercing foils are also beneficial for the boat stability, acting like a heel when the hull hovers over the water, generating righting forces. This inherent stability makes the surface-piercing foil a popular solution, but the problem comes at speeds slower than the takeoff speed, when the foils are immersed and hamper performance by their drag when compared to the same bare hull without foils.

On the other hand, this righting effect also tends to make the boat oscillate laterally when the boat rides into disturbed water resulting in a rough ride.

Furthermore, the width added by the foils to the hull overall width, more particularly for a monohull boat, makes the boat difficult to maneuver and more particularly to dock.

Surface-piercing foils have other drawbacks. Because of the equilibrium effect described above, the hydrodynamic turbulent flow giving rise to the lift, takes place close to the water free surface thus generating waves, and therefore energy loss, waves that may also disturb river or lake banks or shaking third parties' yachts that may be docked or at anchor there. For this reason, boats having such device may only take advantage of it once they are far enough off coast.

Furthermore, when the water surface is wavy the surface-piercing foil, by its very operating principle, tends to follow a non-flat surface and make the boat goes up and down and to amplify the effect of the waves.

Fully submerged foils, where the wing giving rise to the lift remains fully under the water at all time, offer the lowest drag, because the foil surfaces generating the main components of the vertical lift, are deeper and more remote from the free surface.

Consequently, the effect of the flow generating the lift has very little impact on the free surface leading to little to no wave generation at the free surface, and the lifting force is weakly influence by the waves.

However, such submerged foils have to include means for controlling the ride height depending on the ride speed, since they are not self regulating as surface-piercing foils.

Furthermore, when the surface area of the foil is increased in order to provide a takeoff at a lower speed, the width of the foil may extend passed the width of the hull making the boat even more difficult to maneuver, since the foils are not visible from the deck, and the boat becomes difficult or even impossible to dock without additional protection.

Finally, in embodiments where the boat is propelled by a propeller, the set up has to be designed such that the propeller stays well under the water even when the hull takes off.

A solution known from the prior art consists in attaching a propeller to a strut holding a foil. However, such a technical solution leads to complex mechanical transmission in the case of a foldable foil if the engine stays onboard or limits the installable power if the motor is into a pod hanged to the strut.

SUMMARY OF INVENTION

A solution to the above-mentioned deficiencies comprises a foldable hydrofoil for a boat, wherein the foldable hydrofoil comprises:

- a strut comprising a strut length comprised between a proximal end and a distal end;
- a controllable pivotal mechanism comprising a fixed portion and a mobile portion pivotable relative to the fixed portion around a pivotal axis according to a pivotal angle and connected to the proximal end;
- a wing extending along a wingspan connected at the distal end by a controllable orientation mechanism configured to rotate the wing around an orientation axis relative to the strut; and the foldable hydrofoils being configured to be attached to a hull by the fixed portion of the controllable pivotal mechanism;

wherein the controllable orientation mechanism is configured to orient the wing relative to the strut in any position of a wing angle around the orientation axis comprised between 0° where the wingspan is parallel to the strut length and 90° where the wingspan is perpendicular to the strut length regardless the pivotal angle.

Thus, the hydrofoil may be folded out of the water to reduce the overall width of the boat, the orientation mechanism of he wing enable to configure the hydrofoil as an underwater foil or as a surface-piercing foil, thus providing flexibility in the control of the ride depending on a cruising speed.

The foldable hydrofoil may be implemented according to the embodiment and variants disclosed hereafter that may be considered individually or according to any technically operable combination, According to an embodiment, the controllable orientation mechanism comprises a wing locking mechanism configured to lock the orientation mechanism in at least two wing locking positions around the orientation axis.

Advantageously, the lock mechanism comprises at least one wing locking position around the orientation axis at an intermediate wing angle inside 0° to 90°.

According to an embodiment, the pivotal axis and the orientation axis are perpendicular.

According to another embodiment, the pivotal axis and the orientation axis are parallel.

Advantageously, the pivotal mechanism comprises a strut locking mechanism configured to lock the controllable pivotal mechanism in at least three strut locking positions at strut angles comprised between 0° and 180° around the pivotal axis.

The strut locking mechanism may comprise an intermediate strut locking position at an intermediate strut angle inside 0° to 90°.

According to an embodiment, the controllable orientation mechanism comprises:

a rod extending inside the strut and comprising at one end a rack configured to gear with a pinion connected to the wing;

the orientation angle of the wing being controlled by translating the rod inside the strut.

According to another embodiment, the controllable orientation mechanism comprises:

a shaft extending inside the strut and comprising at one end a first bevel gear configured to gear with a second bevel gear connected to the wing;

the orientation angle of the wing being controlled by rotating the shaft inside the strut.

The above mentioned foldable hydrofoil may be implemented on a watercraft comprising a hull with a hull width measured between a port side and a starboard side, comprising:

an aft set making an aft hydrofoil comprising an aft wing and an aft strut supporting the aft wing, the aft wing having an aft wingspan extending between a port aft wing tip and a starboard aft wing tip, a front set comprising a port foldable hydrofoil and a starboard foldable hydrofoil, each of the port foldable hydrofoil and the starboard foldable hydrofoil comprising a front strut pivotally connected to the hull at a proximal end and supporting a front wing connected to a distal end of the front strut by a controllable orientation mechanism;

each front wing extending between an inner tip and an outer tip;

a controllable pivotal mechanism configured to pivot each foldable hydrofoil around a pivotal axis according to a strut angle comprised between 0° where the front strut is vertical and the distal end of the front strut is under a water surface and a stow angle wherein the distal and of the front strut is over the water surface;

each controllable orientation mechanism being configured to pivot the wing around an orientation axis by a wing angle comprised between 0° where a front wingspan is parallel to the front strut and 90° where the front wingspan is perpendicular to the front strut;

wherein, when the foldable hydrofoils of the front set are in a configuration where the strut angle is 0° and the wing angle is 90°, the outer tips of the wings of the front set are outside the hull width and a front wing spacing measured between the inner tips of the front wings is equal or larger than the aft wingspan.

Advantageously, a port gap measured parallel to the aft wingspan between the port aft wing tip and the inner tip of the front wing of the port foldable hydrofoil and a starboard gap measured parallel to the aft wingspan between the starboard aft wing tip and the inner tip of the front wing of the starboard foldable hydrofoil are comprised between 0 and 20% of the aft wingspan and smaller than 20% of the front wingspan.

According to an embodiment, an inner span between the front wing orientation axis and the front wing inner tip is equal or smaller than a outer span between the front wing orientation axis and the front wing outer tip.

According to an embodiment, the aft strut is vertically movable relative to the hull.

Advantageously, the aft wing comprises an aft wing surface connected to the aft strut and a flap pivotally connected to the aft wing.

Advantageously, the front wings comprise front wing flaps.

According to an embodiment, the pivotal axis is perpendicular to the orientation axis.

According to another embodiment, the pivotal axis is parallel to the orientation axis.

According to an embodiment the watercraft comprises two aft struts, the aft wing extending between the two aft struts.

A rudder may be pivotally connected to the aft strut.

Advantageously, the aft wing may be pivotally connected to the aft strut by a pivot link around a transverse axis and configured to set and lock a rake angle of the aft wing.

Advantageously, the front wing of a front foldable hydrofoil is connected to the front strut by a pivot link around a front transverse axis configured to set and to lock a front rake angle of the front wing.

The watercraft may comprise a propeller driven by a pod connected to one among the front struts and the aft struts.

According to an embodiment, each of the two aft struts comprises a pod driving a propeller each propeller being driven in contra rotation with regard to a tip vortex generated at the tip of a front wing.

The watercraft may comprise a flight control system adapted to maintaining a ride height of the watercraft according to a cruising speed.

The flight control system is configured to setting the cruising speed and depending on an actual speed of the watercraft, setting and maintaining a wing angle.

BRIEF DESCRIPTION OF THE DRAWINGS

The foldable hydrofoil and the watercraft may be implemented according to the following exemplary embodiments in no way limiting and in reference to FIG. 1 to FIG. 14 wherein.

DESCRIPTION OF EMBODIMENTS

Figure 12:
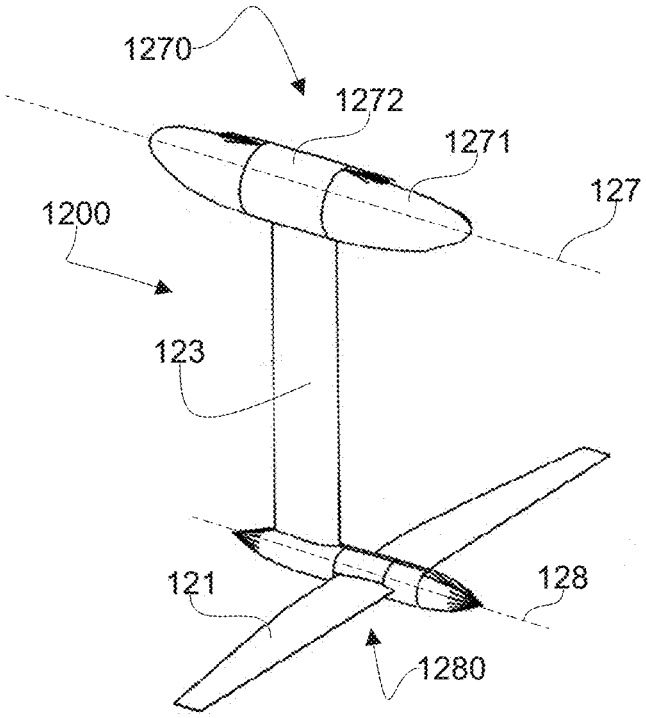
FIG. 12 is a perspective view of an exemplary embodiment of a foldable hydrofoil.

FIG. 12 according to an exemplary embodiment, a foldable hydrofoil (1200) comprises a strut (123) connected to a controllable pivotal mechanism around a pivotal axis (127) at a proximal end of the strut (123) and to a wing (121) at a distal end of the strut (123) through a controllable orientation mechanism (1280) around an orientation axis (128) of the wing (121).

The controllable pivotal mechanism (1270) of the strut comprise a fix portion (1271) configured to be connected to a hull of a boat, and a mobile portion (1272) connected to the strut.

Figure 13:
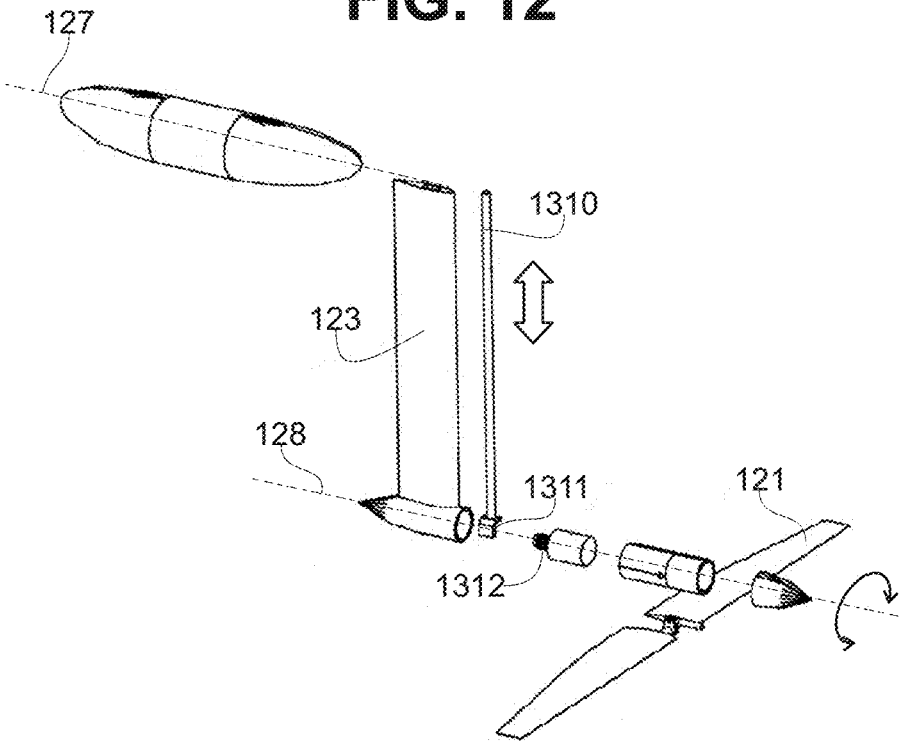
FIG. 13 is a perspective exploded view of an exemplary embodiment of a foldable hydrofoil.

FIG. 13 according to an embodiment the strut (123) may be hollow and housing a rod (1310) comprising at one end a rack (1311) configured to gear with a pinion (1312) so that when the rod (1310) is translated inside the strut (123) the rack and pinion mechanism rotates the wing (121) around the orientation axis (128), thus enabling to control an orientation of the wing around the orientation axis (128) relative to the strut (123) regardless of an orientation of the strut around the pivotal axis (127).

Figure 14:
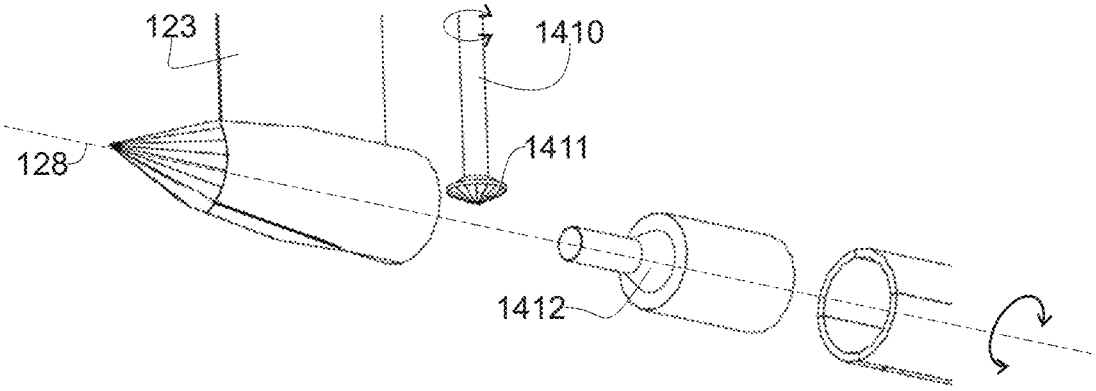
FIG. 14 is a partial perspective exploded view of another embodiment of a foldable hydrofoil.

FIG. 14 according to another exemplary embodiment the controllable orientations mechanism comprises a shaft (1410) extending in the hollow strut and comprising a first bevel gear (1411) configured to gear with a second bevel gear (1412) connected to the wing. Therefore, the orientation angle of the wing relative to the strut may be controlled by rotating the shaft (1410).

Advantageously, the orientation mechanism, whatever the embodiment, may comprise a wing locking mechanism configured to lock the wing in specific angular orientations relatives to the strut comprising at least a 0° angular position where a wingspan is parallel to a strut length extending between the proximal end and the distal end of the strut, and a 90° angular position where the wingspan is perpendicular to the strut length.

In a preferred embodiment the locking mechanism further comprise at least one additional intermediate locking position between the two latter, e.g. for a wing orientation of 45°.

As a non-limiting example such a locking mechanism i\may be provided by a jaw clutch.

Figure 1:
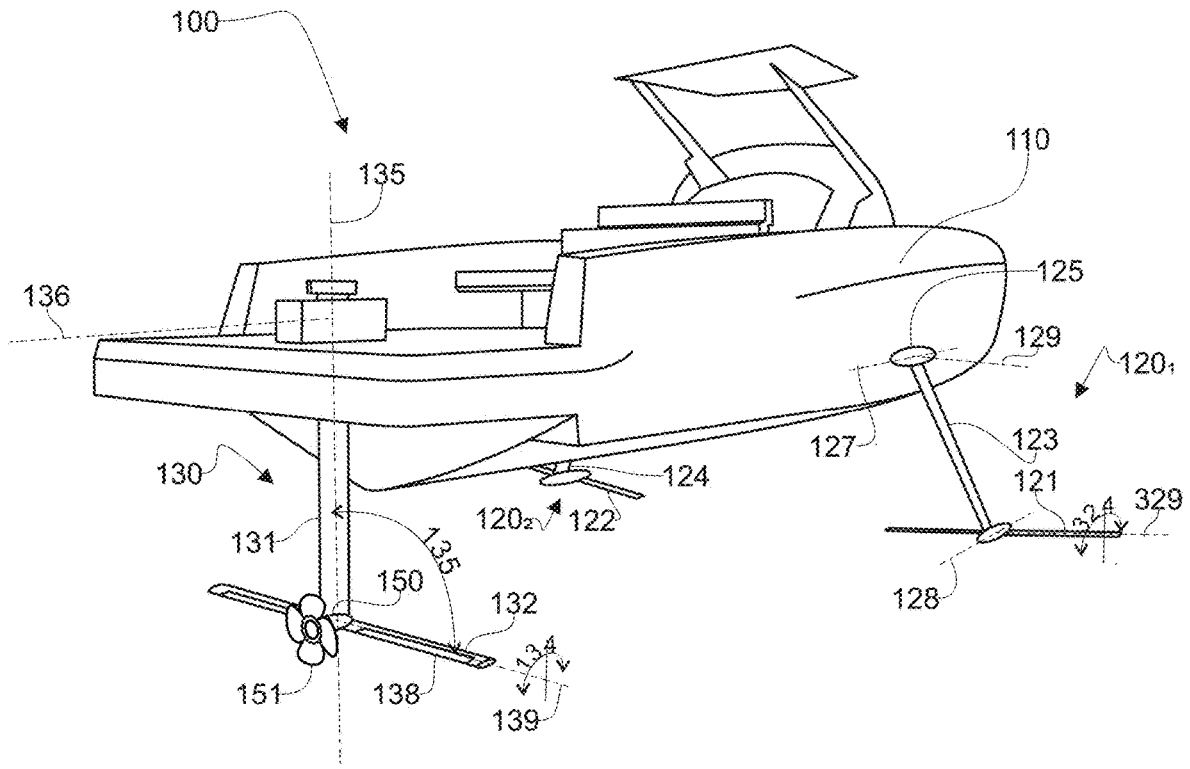
FIG. 1 is a perspective view from the rear of a watercraft implementing n exemplary embodiment.

FIG. 1 according to a non-limiting exemplary embodiment, a watercraft comprises at least one displacement hull (110) to which a front set comprising a starboard front hydrofoil ($\mathbf{120}_1$) and a port front hydrofoil ($\mathbf{120}_2$) is attached.

Each front hydrofoil comprises a strut (123, 124) pivotally connected to the hull (110) at one of its ends by a hull pivoting link (125) and means for controlling and locking an angular position of the strut (123, 124) relative to the hull.

Each front hydrofoil comprises a wing (121, 122) at the opposite end of the front strut (123, 124).

Each front hydrofoil may thus be pivotally moved relative to hull according to a front strut angle around a hull pivoting axis (127), from a 180° position where the front strut (123, 124) is substantially vertically aligned with the hull and the front wings (121, 122) are out of the water, to a 0° position where the front strut (123, 124) is substantially vertically aligned with the hull (110) and the front wings (121, 122) are immersed in the water.

The pivoting axis (127) of the strut relative to the hull may be substantially aligned with the hull and substantially parallel to a roll axis of the hull, but may also be an alternative pivoting axis (129) substantially perpendicular to the hull, substantially parallel to a pitch axis of the hull.

The watercraft may further comprise an aft hydrofoil (130). The aft hydrofoil is connected to the hull (110) by at least one aft fin-like strut (131) and comprising at an end an aft wing (132).

The aft strut (131) may be connected to the hull by a slidable link parallel to a vertical axis (135) and associated control means enabling the aft hydrofoil to be vertically movable from a position where the aft wing (132) is closer to the hull and may be out of the water, to a position remote from the hull where the aft wing (132) is submerged at a given depth in the water.

The aft wing may comprise an aft wing flap (138) at its trailing edge, pivotally connected to the aft wing.

The aft wing may comprise two aft half wings extending on each side of the aft strut (131), and each aft half wing may comprise an aft wing flap (138) pivotally connected to the wing according to a transverse axis (139).

The aft set (130) may comprise a pod (150) that may be attached to an end of a strut or to the wing. The pod may comprise means adapted to drive a propeller (151). When the pod is connected at the end of an aft strut between the strut and the wing, it may also comprise a mechanism for setting and locking a cant orientation angle (135) of the half wing relative to the aft strut (131), enabling the two half wings to be set in an anhedral, dihedral or horizontal configuration.

The connection between an aft wing (132) and the strut may also comprise a mechanism for setting and locking a rake angle (134) around the transverse axis (139). Adjusting the rake angle (134) has a similar effect than the flap (138) and allows to adjust the lift of the wing with respect to a speed of the watercraft.

The propeller (151) may be driven by an onboard engine or may be driven by a motor partly or fully comprised in the pod (150), of the internal combustion, hydraulic, pneumatic or electrical type.

When the motor is of the electrical type it may be supplied in energy by an onboard battery and/or by a fuel cell.

Figure 2:
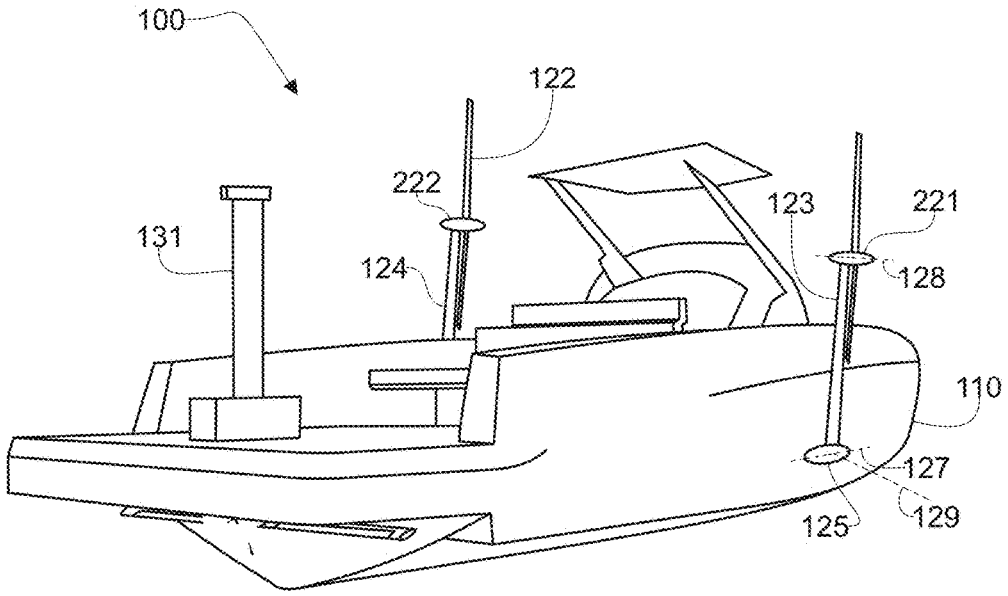
FIG. 2 is perspectives view from the rear of the watercraft of FIG. 1 in a docking configuration.

FIG. 2, when the watercraft (100) is configured for maneuver or for docking the aft strut (131) is preferably raised relative to the hull (110) and the front struts (123, 124) are preferably pivoted on the 180° positions so that the front wings (121, 122) are out of water, thus reducing the drag and the overall width of the watercraft.

The front wings (121, 122) may be connected to the front struts (123, 124) by strut pivoting links (221, 222) comprising means to control and to lock a relative angular position of the front wings (121, 122) with regard to the front struts (123, 124) according to a front wing orientation axis (128) at least over a range covering a 90° position where the front wing is substantially perpendicular to the front strut and a 0° position where the front wing (121, 122) is substantially parallel to the front strut (123. 124).

Figure 3:
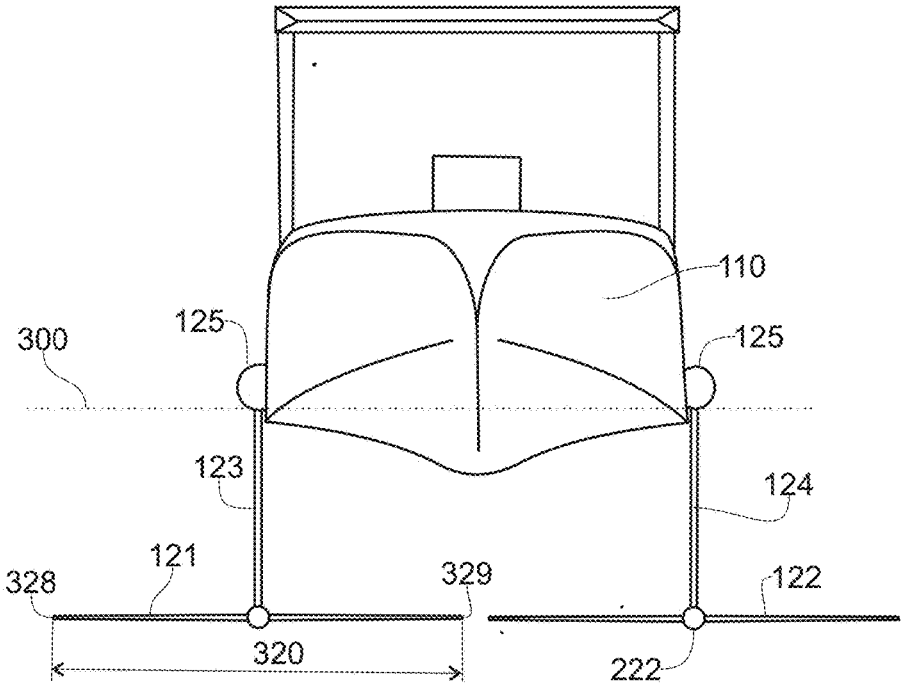
FIG. 3 is a front view of an exemplary embodiment with the front wings in a horizontal position in the water.

FIG. 3 when the pivoting link axis is substantially parallel to the roll axis of hull. when the front struts (122, 123) are in the 0° position according to a cant angle the front wings (121, 122) are fully submerged under the water free surface (300).

Each front wing (121, 122) extends over a wingspan (320) between an inner tip (329) and an outer tip (328). The distance between the pivotal axis (128) of the wing orientation mechanism (221, 222) around the orientation axis and the outer tip (328) may be equal to the distance between the orientation axis and the inner tip (329), in such case the front wing is symmetric relative to the front strut, or, the two distances may be different, and the front wing extends asymmetrically relative to the front strut.

As with the aft wing, each front wing (121, 122) may comprise two half front wings that may be pivoted individually around the front wing orientation axis (128) according to a cant angle, and thus, for each front hydrofoil the couple of front half wings may be set in an anhedral, dihedral or horizontal configuration.

Additionally, the orientation mechanism (221, 222) may further comprise means for setting and locking a rake angle (324 in FIG. 1) around a transversal axis (329 in FIG. 1)

Figure 4:
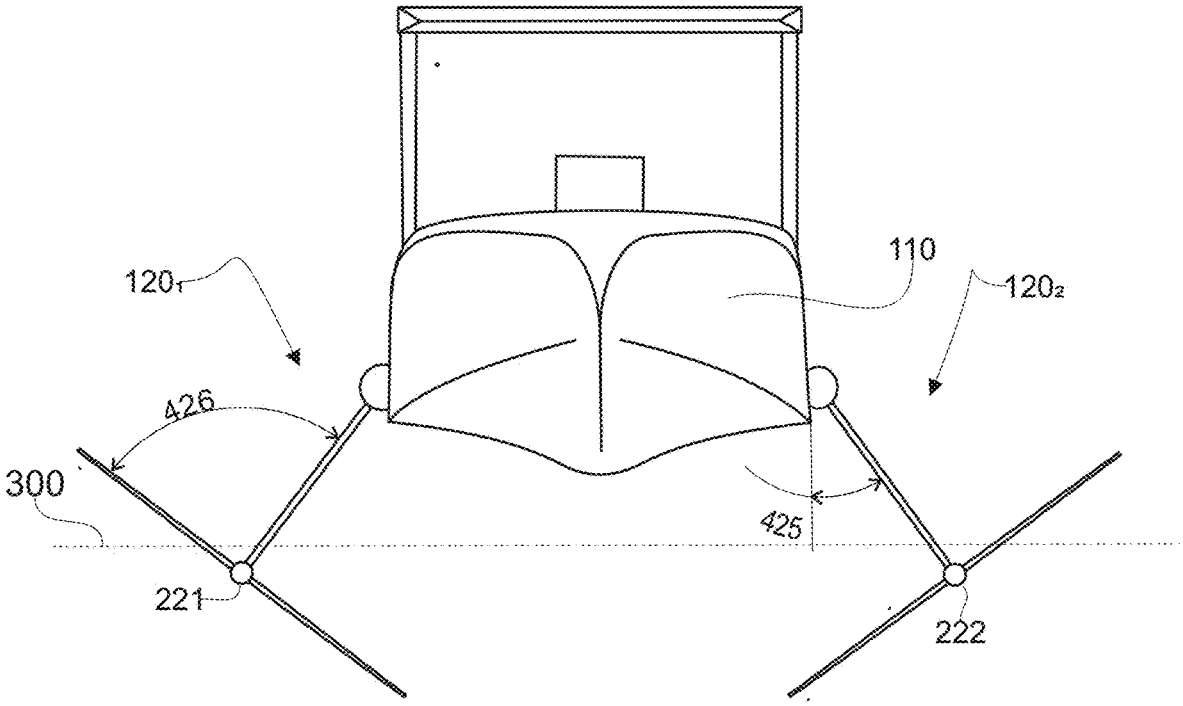
FIG. 4 is a front view of an exemplary embodiment with the front wings in a surface piercing configuration.

FIG. 4 by controlling the hull pivoting links (125), a strut cant angle (425) may be set between 0° and 180°, and by controlling the orientation mechanism (221, 222) a wing orientation (426) may be set between 0° and more than 90°. Thus, when the front struts are set at a strut angle (425) higher than 0° but at an acute angle, the front set ($\mathbf{120}_1$, $\mathbf{120}_2$) may be configured in a surface-piercing configuration while the hull (110) is hovering over the water free surface (300).

According to this embodiment, when the strut cant angle (425) is set to 180° and the orientation angle (426) of the wing is set to 0° the foldable hydrofoil is in a stow configuration.

Although FIG. 4 shows a substantially symmetric configuration where the strut cant angle and the wing cant angle are substantially the same for each front hydrofoil of the set, each front hydrofoil may be configured individually.

Figure 5:
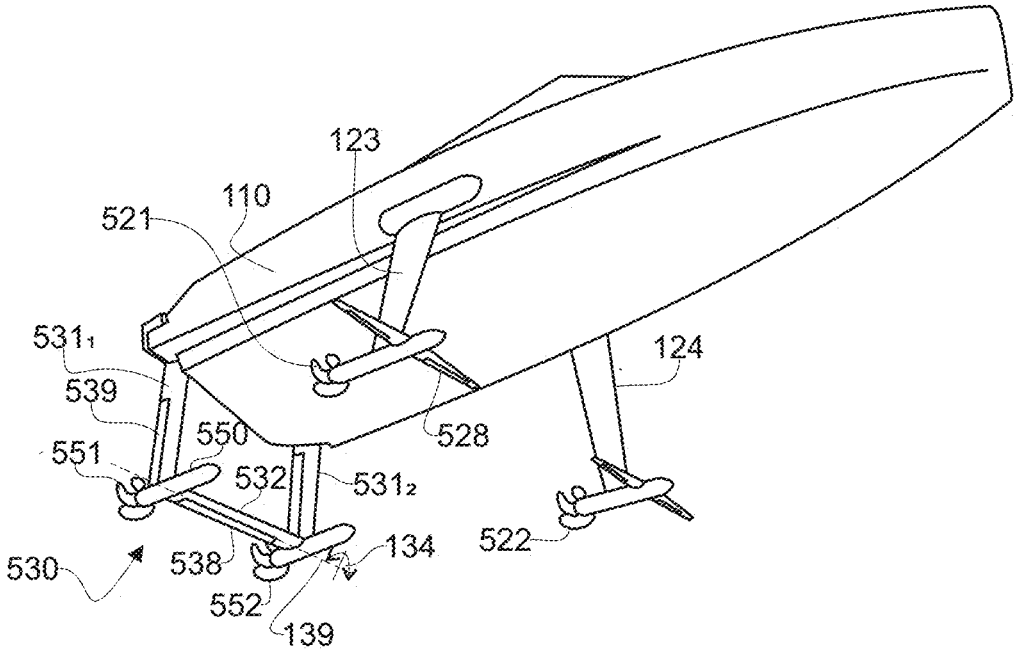
FIG. 5 is an underneath perspective view of a watercraft comprising 4 propellers.

FIG. 5 the aft set (530) may comprise a horizontal aft wing (532) hold by a pair (5311, 5312) of aft struts.

The aft wing (532) may comprise a flap, pivotally connected to the wing around a transverse axis (139), and each aft strut (5311, 5312) may comprise a rudder (539).

The aft wing (532) may be connected to the struts (5311, 5312) through mechanisms enabling the setting and the locking a rake angle (134) of the wing, This mechanism may be used to control the lift force generated by the wing at a given speed, in lieu or in combination with the flap.

The two aft struts (5311, 5312) may be connected to the hull (100) by a slidable link allowing to move the aft wing and the aft struts up and down relative to the hull (110)

Each aft strut (5311, 5312) may support at its end a pod (550) comprising a motor driving a propeller (551, 552).

The watercraft may further comprise a pod comprising a motor driving a propeller (521, 522) connected at the end of each front strut (123, 124). And each front wing may further comprise a front wing flap (528) and/or a rake angle setting mechanism.

Therefore, combining the aforementioned embodiments the watercraft may comprise 1, 2, 3 or 4 propellers attached to the struts of the foils.

Figure 6:
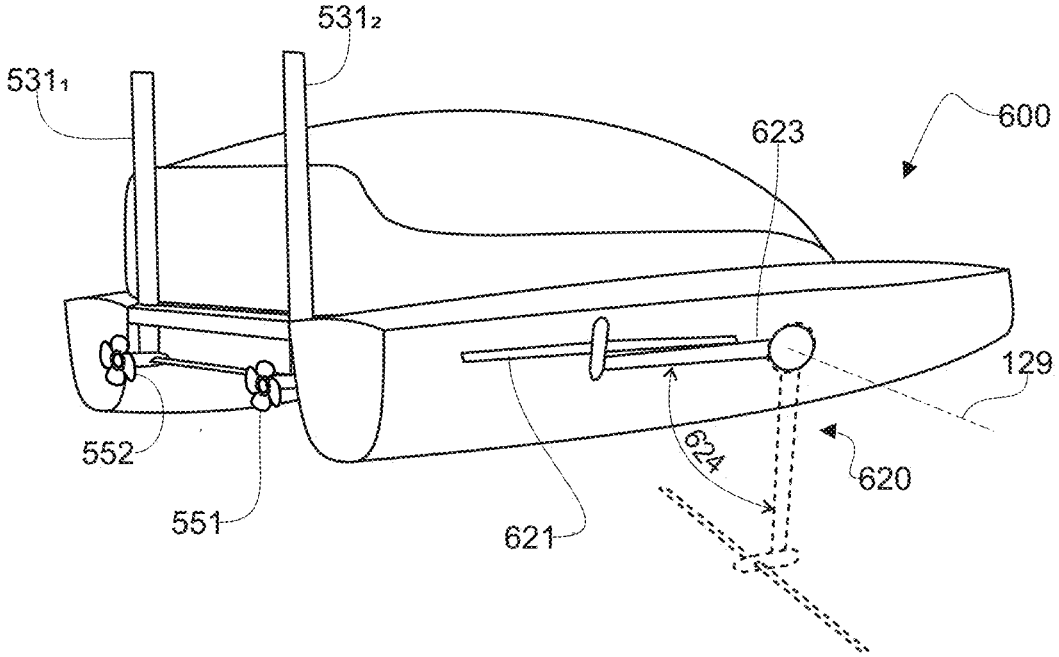
FIG. 6 is a perspective view from the rear of a multi-hull watercraft in a docking configuration.

FIG. 6, the watercraft is in no way limited to a monohull boat but may comprise multiple hulls like a catamaran style boat (600). Here shown in a docking configuration. And such a multi-hull configuration may be implemented with 1, 2, 3 or 4 propellers.

Although not limited to a catamaran style boat, the front set may comprise hydrofoils (620) wherein the front strut (623) is pivotally connected to the hull around an axis (129) substantially parallel to a pitch axis of the hull. The front wing (621) is connected to the front strut (623) similarly as disclosed in the embodiments hereinabove.

In such an embodiment when the strut is pivoted at an angle of 0° and the wing is set at an orientation of 0° the front hydrofoil is in a stow configuration. The hull may comprise a housing (not shown) extending along the hull, configured to hide the foldable hydrofoil in such a stow configuration.

This embodiment also enables to set a rake angle (634) of the hydrofoil (620) and the wing (621) by acting on the front strut allowing to set up a stiffer mechanism for the adjustment of this parameter.

Figure 7:
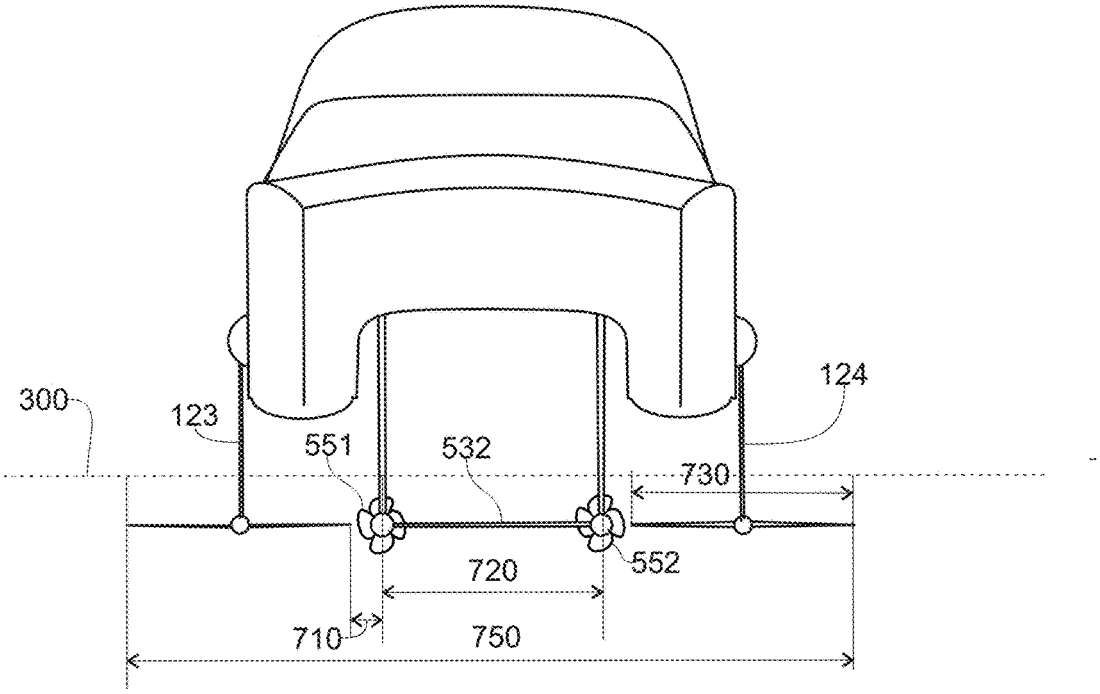
FIG. 7 is a front view of an embodiment of the watercraft in a lift up riding configuration.

FIG. 7 whatever the hull, mono or multi-hull the hydrofoil system may be organized between the front set and the aft set, in order to increase the apparent wingspan, to reduce the drag and to improve the propellers' efficiency.

To this end, the wingspan (720) of the aft wing (532) is advantageously comprised between the inner tips of the front wings. In such a configuration the watercraft behaves like if it comprised a hydrofoil with a wingspan (750) almost equivalent to the sum of the wingspans for the aft wing and the two front wings, meaning from a fluid dynamics point of view the 3 hydrofoils (2 fronts+1 aft) are working as if it was a "continuous" hydrofoil of higher span.

Without being stuck to any theory this effect is explained by the Munk's stagger theorem.

In order to take advantage of the Muck's staggered theorem effect, a gap (710) measured along a wingspan between the inner tips of the front wings and the outer tips of the aft wing shall be 0 or less then 20% of both the wingspan (720) of the aft wing and the wingspan (730) of the front wing. The smaller the gap, the higher the effect.

This apparent larger wingspan allows the watercraft to takeoff over the water free surface (300) at a slower speed thus reducing the induced drag at slow speeds, but moreover the aft hydrofoil will be in the upwash created by the 2 front wings thus furthermore reducing the drag.

Moreover, as a known phenomenon, vortexes are created in the hydrodynamic flow at the tips of the front wings. This swirling flow may be taken advantage of, if the aft propellers (551, 552) are set up on each side of the aft wing.

As a matter of fact, with such propellers spinning in contra rotation of the swirling effect, the energy dissipated in the vortexes may be partly recovered for propelling.

The configuration shown in FIG. 7 is further advantageous because the wings are fully submerged, thus not creating waves.

As a consequence, such a configuration is particularly advantageous for low emission commuting boats like taxi boats or bus boats or ferries, equipped with an electric propulsion and operating on a river or a lake.

Figure 8:
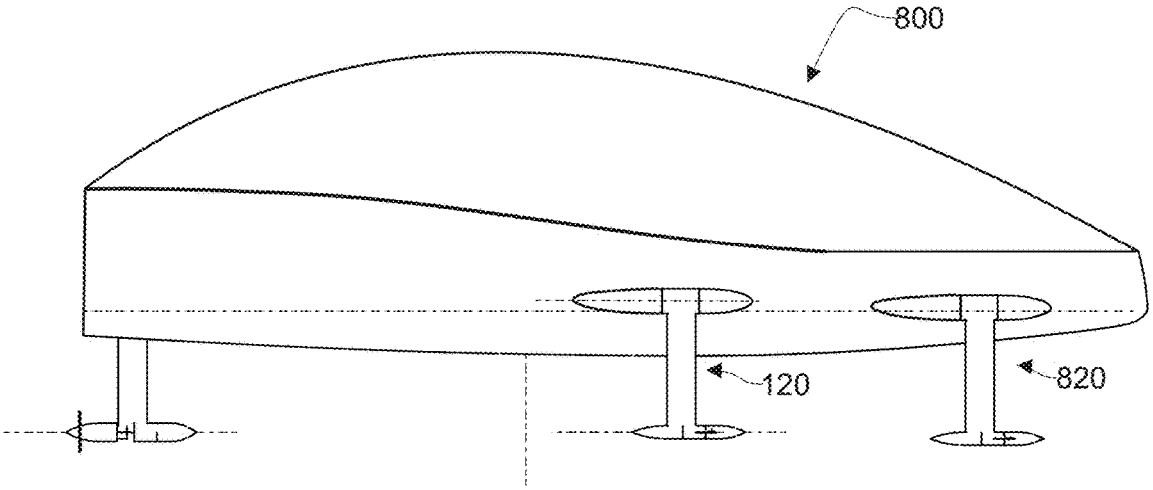
FIG. 8 is a side view of an exemplary embodiment of a watercraft comprising more than one front set.

FIG. 8, when the hull of the watercraft is long, the watercraft (800) may comprise additional front sets (120, 820). The wings of the different sets may be submerged at different depths. Some sets may be configured in a submerged wing configuration while some others may be set in a surface-piercing hydrofoil configuration. Each additional set may comprise a pod and a propeller.

Figure 9:
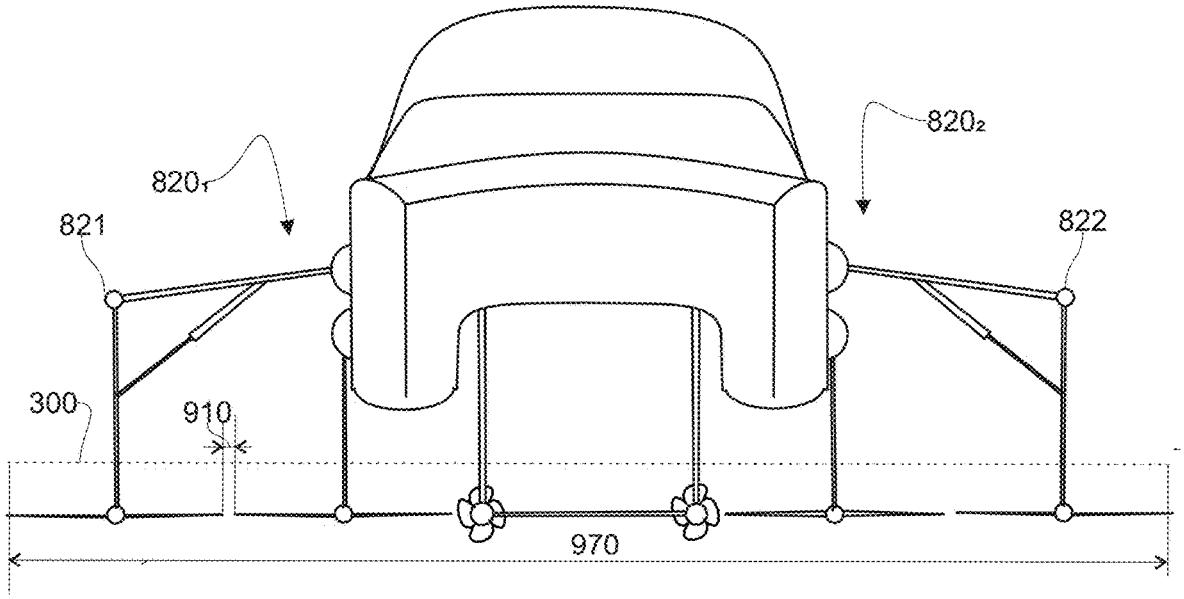
FIG. 9 is a front view of an exemplary embodiment of a watercraft comprising more than one front set.

FIG. 9, to this end, one ore more hydrofoil sets (8201, 8202) may comprise an additional pivot link (921, 922) the strut being articulated in two parts.

Taking advantage of the Munk's staggered theorem this configuration allows a super wide wingspan (970) while keeping the ability to dock the watercraft by folding the hydrofoil out of the water.

In such a configuration a gap (910) measured along a wingspan direction of two consecutive wings according to a pitch axis direction shall not exceed 20% of each consecutive wingspans Distributing the wingspan between multiple hydrofoil sets allows to both reduce the takeoff speed of the boat and to reduce the induced drag of the hydrofoils.

Induce drag is predominant at low speed, before takeoff, while viscous drag becomes predominant at high speed, e.g. above the takeoff speed.

Figure 10:
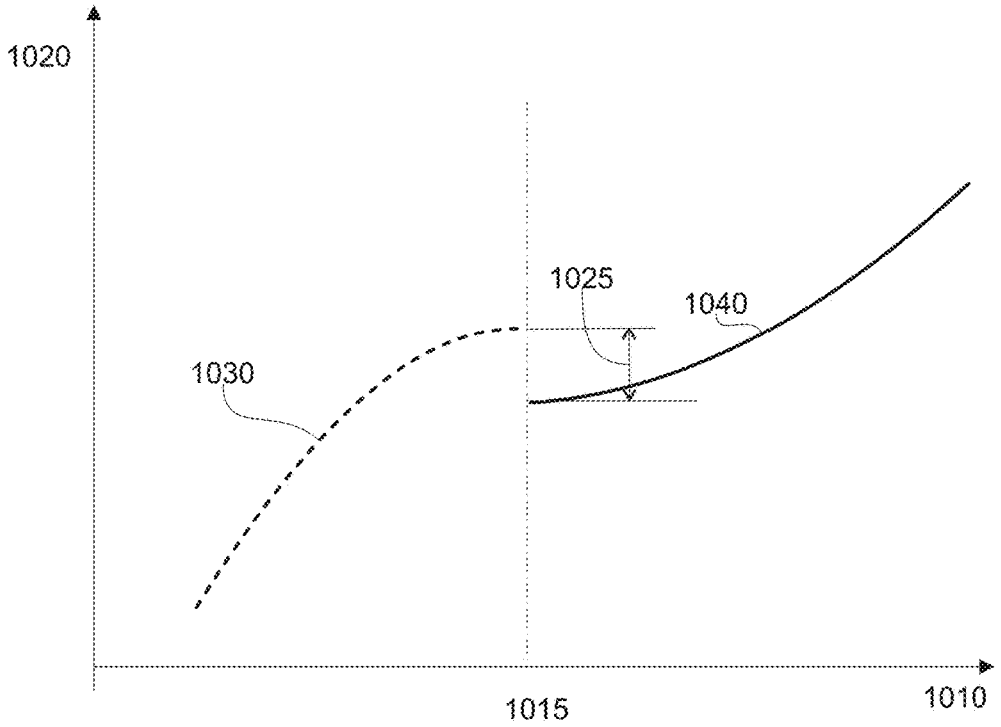
FIG. 10 is a diagram showing an exemplary evolution of the drag of a boat comprising a foil set with the riding speed.

FIG. 10 the evolution of the drag force (1020) with the cruising speed (1010) shows a drop (1025) in the drag force once the watercraft reaches the takeoff speed (1015).

The evolution of the drag (1030) when the watercraft flotation relies on Archimedean thrust applied to the displacement hull, shows that there may be a significant drag to overcome before the drag is governed by the full foiling evolution (1040).

All other things being equal, the takeoff speed is lower when the surface S of the wings is higher, All other things being equal, the induced drag which is predominant along the majority of the Archimedean thrust curve (1030) is inversely proportional to an aspect A ratio of the wing:

where $$A = \frac{B_2}{S}$$

Where B is the wingspan.

Therefore, the induced drag may be reduced by increasing the aspect ratio A of each wing in each hydrofoil.

The take off speed may also be adjusted by controlling the rake angle of the hydrofoils e.g. by controlling the strut angles, the wing angles and the flaps positions in order to reduce this drag, which can also lead to an optimization of the hull shape taking advantage of the combination of the Archimedean thrust force and the lifting force of the foils even before fully takeoff.

Figure 11A:
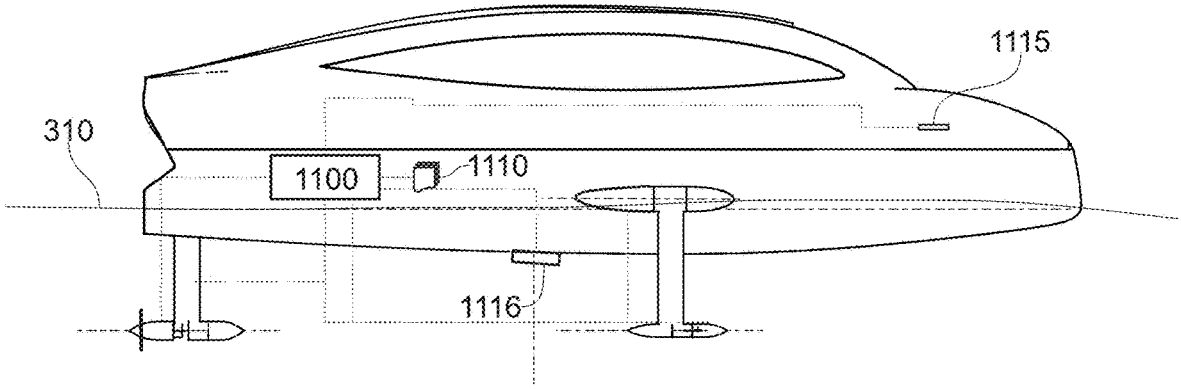
FIG. 11A is a side view of a watercraft cruising at a speed below the takeoff speed.
Figure 11B:
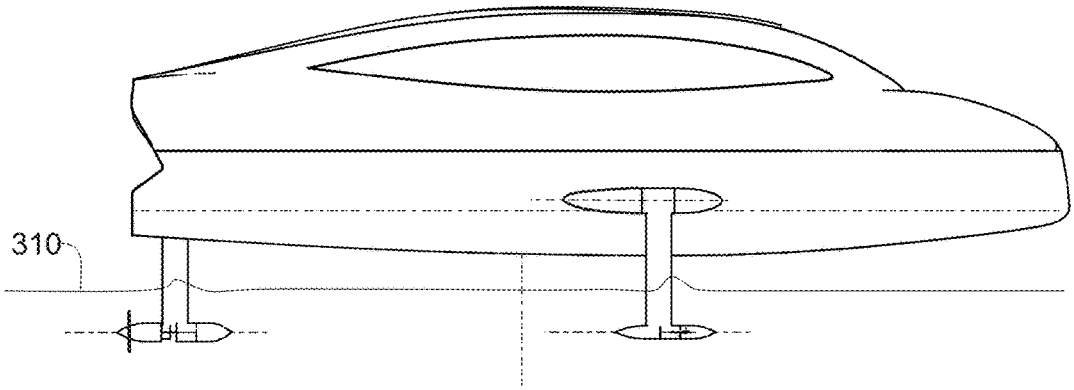
FIG. 11B is a side view of a watercraft cruising at a the takeoff speed.
Figure 11C:
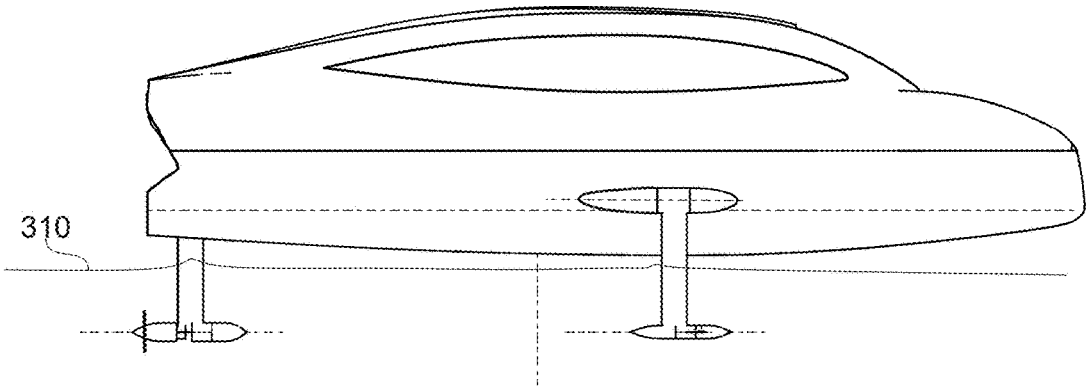
FIG. 11C is a side view of a watercraft cruising at a speed over the takeoff speed.

FIG. 11A to FIG. 11C are showing the variation of the wave elevation profile depending on the speed of the watercraft. FIG. 11A before takeoff, FIG. 11B at takeoff and FIG. 11C over the takeoff speed. Over the whole range the wave elevation remains below 20 cm.

The watercraft may comprise a computerized flight control system (1100) comprising memory leans in which a mapping (1110) of the performance of the watercraft are recorded in the form of a data base.

Such a mapping (1110) may comprise for each speed: the drag, the Archimedean thrust provided by the hull according to the waterline height and the lift force provided by each set of hydrofoils.

The lift force may further be given according to the strut angle, the wing orientation angle and the flap orientation.

The database may be built by hydrodynamic simulation and may be further improved by real tests.

The flight control system may acquire a riding speed of the watercraft, e.g. through a pitot tube (1135) and a propelling power. It may further acquire a free surface position though an ultrasonic sensor (1116). With this set of information and using the performance database (1110) the computerized flight control system will pilot the hydrofoil sets in order to control the ride conditions.

The control of the riding conditions may be performed by controlling one or more parameter among:

- an height of the aft hydrofoil,
- the aft wing angle (135)
- the front hydrofoil strut angles (425) and the front wings orientation angles (426)
- the rake angles (134, 324) of the wings or of the struts (624).
- a rotating speed and a pitch of the propellers,
- when relevant, a configuration of the aft half wings, in anhedral, dihedral or horizontal configuration,
- a configuration of the front half wings in anhedral, dihedral or horizontal configuration,
- the flaps (138, 538, 528) of the aft wing and of the front wings.

EXAMPLES

The table hereunder shows some examples of watercraft implementing the invention.

| FIG. | FIG. 7 | FIG. 5 | FIG. 5 | FIG. 5 |
|---|---|---|---|---|
| Type of hull | catamaran | monohull | monohull | monohull |
| Type of foils | Immersed foils | Immersed foils | Piercing foils with flight control | Immersed foils |
| Length | 9.97 m | 13 m | 13 m | 13 m |
| Beam (excl. foils) | 4.13 m | 4.1 m | 4.10 m | 4.1 m |
| Full load weight | 6 tons | 12.5 tons | 12.5 tons | 12.5 tons |
| Number of propellers | 2 (aft) | 2 (aft) | 2 (aft) | 2 (aft) |
| Full power | 160 kW | 450 kW | 450 kW | 450 kW |
| Front wing span | 1.75 m | 2.60 m | 2.60 m | 2.60 m |
| Aft wing span | 1.75 m | 2.8 m | 2.60 m | 2.60 m |
| Full equivalent wing span | 5.710 m | 8.5 m | 7.70 m | 8.50 m |
| Takeoff speed | 18-20 knots | 20 knots | 20 knots | 20 knots |

-continued

| | | | | |
|---|---|---|---|---|
| Cruising speed | 25-30 knots | 30-35 knots | 30-35 knots | 30-35 knots |
| Top speed | 34 knots | 45 knots | 45 knots | 45 knots |

The invention claimed is:

1. A foldable hydrofoil for a boat, wherein the foldable hydrofoil comprises:

a strut comprising a strut length comprised between a proximal end and a distal end;

a controllable pivotal mechanism comprising a fixed portion and a mobile portion pivotable relative to the fixed portion around a pivotal axis according to a pivotal angle and connected to the proximal end;

a wing extending along a wingspan connected at the distal end by a controllable orientation mechanism configured to rotate the wing around an orientation axis relative to the strut; and the foldable hydrofoils being configured to be attached to a hull by the fixed portion of the controllable pivotal mechanism;

wherein the controllable orientation mechanism is configured to orient the wing relative to the strut in any position of a wing angle around the orientation axis comprised between 0° where the wingspan is parallel to the strut length and 90° where the wingspan is perpendicular to the strut length regardless the pivotal angle.

2. The foldable hydrofoil of claim 1, wherein the controllable orientation mechanism comprises a wing locking mechanism configured to lock the controllable orientation mechanism in at least two wing locking positions around the orientation axis.

3. The foldable hydrofoil of claim 2, wherein the wing locking mechanism comprises at least one wing locking position around the orientation axis at an intermediate wing angle inside 0° to 90°.

4. The foldable hydrofoil of claim 1, wherein the pivotal axis and the orientation axis are perpendicular.

5. The foldable hydrofoil of claim 1, wherein the pivotal axis and the orientation axis are parallel.

6. The foldable hydrofoil of claim 5, wherein the controllable pivotal mechanism comprises a strut locking mechanism configured to lock the controllable pivotal mechanism in at least three strut locking positions at strut angles comprised between 0° and 180° around the pivotal axis.

7. The foldable hydrofoil of claim 6, wherein the strut locking mechanism comprises an intermediate strut locking position at an intermediate strut angle inside 0° to 90°.

8. The foldable hydrofoil of claim 1, wherein the controllable orientation mechanism comprises:

a rod extending inside the strut and comprising at one end a rack configured to gear with a pinion connected to the wing;

wherein the wing angle is controlled by translating the rod inside the strut.

9. The foldable hydrofoil of claim 1, wherein the controllable orientation mechanism comprises:

a shaft extending inside the strut and comprising at one end a first bevel gear configured to gear with a second bevel gear connected to the wing;

wherein the wing angle is controlled by rotating the shaft inside the strut.

10. A watercraft comprising a hull with a hull width measured between a port side and a starboard side, comprising:

an aft set making an aft hydrofoil comprising an aft wing and an aft strut supporting the aft wing, the aft wing having an aft wingspan extending between a port aft wing tip and a starboard aft wing tip;

a front set comprising a port foldable hydrofoil and a starboard foldable hydrofoil, each of the port foldable hydrofoil and the starboard foldable hydrofoil comprising a front strut pivotally connected to the hull at a proximal end and supporting a front wing connected to a distal end of the front strut by a controllable orientation mechanism;

each front wing extending between an inner tip and an outer tip;

a controllable pivotal mechanism configured to pivot each foldable hydrofoil around a pivotal axis according to a strut angle comprised between 0° where the front strut is vertical and the distal end of the front strut is under a water surface and a stow angle wherein the distal and of the front strut is over the water surface; and each controllable orientation mechanism being configured to pivot the wing around an orientation axis by a wing angle comprised between 0° where a front wingspan is parallel to the front strut and 90° where the front wingspan is perpendicular to the front strut;

wherein, when the foldable hydrofoils of the front set are in a configuration where the strut angle is 0° and the wing angle is 90°, the outer tips of the wings of the front set are outside the hull width and a front wing spacing measured between the inner tips of the front wings is equal or larger than the aft wingspan.

11. The watercraft of claim 10, wherein a port gap measured parallel to the aft wingspan between the port aft wing tip and the inner tip of the front wing of the port foldable hydrofoil and a starboard gap measured parallel to the aft wingspan between the starboard aft wing tip and the inner tip of the front wing of the starboard foldable hydrofoil are comprised between 0 and 20% of the aft wingspan and smaller than 20% of a front wingspan.

12. The watercraft of claim 10, wherein an inner span between the front wing orientation axis and the front wing inner tip is equal or smaller than an outer span between the front wing orientation axis and the front wing outer tip.

13. The watercraft of claim 10, wherein the aft strut is vertically movable relative to the hull.

14. The watercraft of claim 10, wherein the aft wing comprises an aft wing surface connected to the aft strut and a flap pivotally connected to the aft wing.

15. The watercraft of claim 10, wherein the front wings comprise front wing flaps.

16. The watercraft of claim 10, wherein the pivotal axis is perpendicular to the orientation axis.

17. The watercraft of claim 10, wherein the pivotal axis is parallel to the orientation axis.

18. The watercraft of claim 10, comprising two aft struts, the aft wing extending between the two aft struts.

19. The watercraft of claim 18, wherein each of the two aft struts comprises a pod driving a propeller each propeller being driven in contra rotation with regard to a tip vortex generated at a tip of the front wing.

20. The watercraft of claim 19, comprising a flight control system adapted to maintaining a ride height of the watercraft according to a cruising speed.

21. The watercraft of claim 20, wherein the flight control system is configured to setting the cruising speed and, depending on an actual speed of the watercraft, setting and maintaining a wing angle.

22. The watercraft of claim 10, comprising a rudder pivotally connected to the aft strut.

23. The watercraft of claim 10, wherein the aft wing is pivotally connected to the aft strut by a pivot link around a transverse axis and configured to set and lock a rake angle of the aft wing.

24. The watercraft of claim 10, wherein the front wing of a front foldable hydrofoil is connected to the front strut by a pivot link around a front transverse axis configured to set and to lock a front rake angle of the front wing.

25. The watercraft of claim 10 or claim 18, comprising a propeller driven by a pod connected to one among the front strut and the aft strut.

26. The watercraft of claim 25, wherein the pod comprises an electrical motor.

* * * * *